United States Patent [19]

Townsend

[11] 4,108,568

[45] Aug. 22, 1978

[54] FAN ROTOR MEANS

[76] Inventor: Darold I. Townsend, 730 Cherry St., Cherokee, Iowa 51012

[21] Appl. No.: 804,546

[22] Filed: Jun. 8, 1977

[51] Int. Cl.[2] ..... F01B 3/02

[52] U.S. Cl. ..... 415/98; 415/102; 415/211

[58] Field of Search ..... 415/83, 86, 87, 98, 415/102, 211; 416/178, 179, 181, 182, 185, 186 R, 187

[56] References Cited

U.S. PATENT DOCUMENTS

| | | | |
|---|---|---|---|
| 978,397 | 12/1910 | Rice | 415/211 |
| 1,029,554 | 6/1912 | Neumayer | 415/87 |
| 1,496,633 | 6/1924 | Hertzler | 415/211 |
| 2,201,437 | 5/1940 | Kice | 415/98 |

*Primary Examiner*—Louis J. Casaregola
*Attorney, Agent, or Firm*—Zarley, McKee, Thomte, Voorhees & Sease

[57] ABSTRACT

A fan rotor means comprising a plurality of blade elements rotatably mounted within a cylindrical shaped cage of L-shaped baffle members attached to and extending between a pair of ring shaped rims. The blade elements are securely attached at one end to a circular plate rotatably mounted within the cylindrical cage with the blade elements extending from the inside circumference of the rims toward the longitudinal center line of the cage and terminating prior to the center line so as to form a cylindrical bore within the cage. The cylindrical cage and blade members are mounted within the center chamber of a three chamber support structure with the rims securely attached to the interior walls of the center chamber. Bushings containing air inlet apertures are located within the walls such that the air inlets are in alignment with the bore and provide passageways between the outer chambers and the bore. A drive shaft is securely attached to the center of the circular plate and operationally attached to a motor for rotational movement thereof. The outer chambers contain air inlet tubes while the center chamber contains an air outlet tube such that air is drawn in the inlet tube into the outer chambers, through the air inlet apertures of the bushings into the bore, and forced by the rotation of the blades through the baffle elements and on through the outlet tube.

5 Claims, 4 Drawing Figures

FAN ROTOR MEANS

BACKGROUND OF THE INVENTION

The invention relates to fan rotor means and particularly to an enclosed chamber fan for high velocity air flow.

Prior fans did not provide high velocity directionalized air flow from an enclosed compartmentized fan structure.

SUMMARY OF THE INVENTION

A fan rotor means is disclosed wherein a cylindrical shaped cage comprised of a plurality of L-shaped baffle members extending between and attached to a pair of oppositely disposed ring shaped rims is securely mounted within the center chamber of a three chamber enclosed support structure. Rotatably mounted within the cylindrical cage is a circular plate having a plurality of blade elements attached thereto in a perpendicular relationship and extending more or less parallel to the baffle members. The blade elements extend inwardly from the inner circumferential edge of the rims toward the longitudinal center line of the cage and terminate prior to the longitudinal center line forming a bore within the cage. A drive shaft securely attached at one end to the center of the circular plate and operationally attached to an exteriorally located motor means for rotational movement of the blade members. Bushings containing air inlet apertures are located in the interior walls adjoining the bore and provide air communication between the outside chambers and the inside bore. The outside chambers contain air inlet tubes while the center chamber contains an air outlet tube. Upon rotation of the blades by the motor means, air is drawn in the inlet tubes through the air inlet apertures of the bushings into the bore formed by the blade elements. The blades then propel the air against the baffle elements which directionalize the air flow and force the air out the tube.

It is a principal object of the invention to provide a fan rotor means that generates high velocity directionalized air flow.

A further object of the invention is to provide a fan rotor means in which the rotational blade elements are completely enclosed.

A further object of the invention is to provide a fan rotor means that is economical to manufacture, simple in construction, and durable in use.

DESCRIPTION OF THE PREFERRED EMBODIMENT

Figure 1:
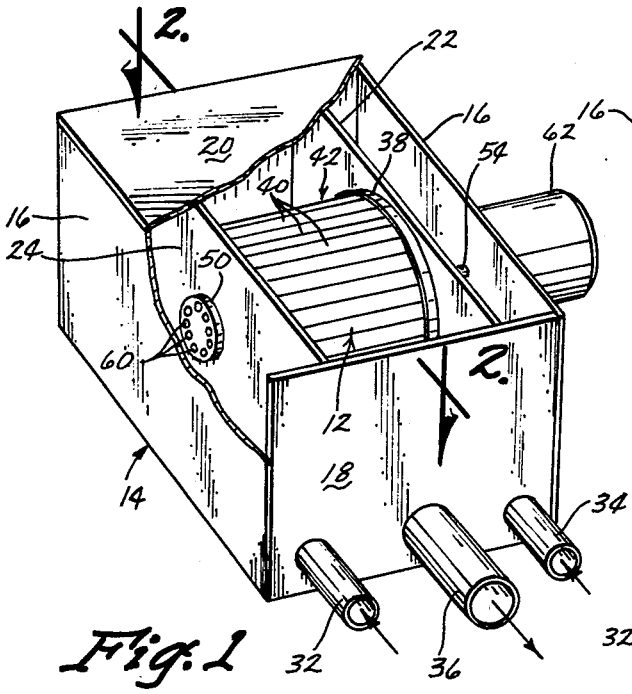
FIG. 1 is a partially broken away perspective view of the invention.
Figure 4:
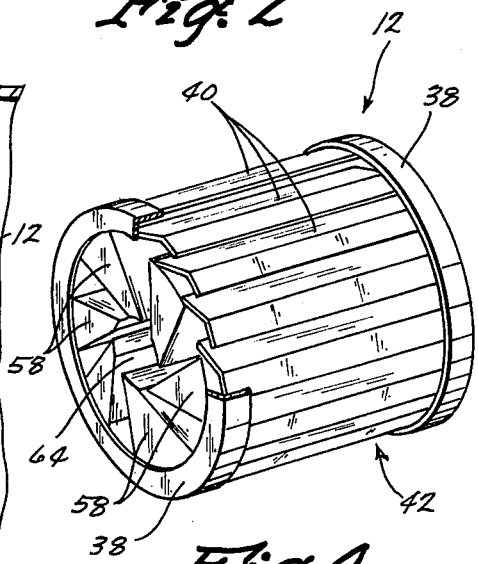
FIG. 4 is a perspective view of the baffle and rotor blades of this invention.

The numeral 10 generally refers to the fan of this device as shown in FIG. 1. Fan 10 is generally comprised of rotor means 12 (FIG. 4) and housing assembly 14.

Housing assembly 14 comprises side wall 16, front wall 18, rear wall 19, top wall 20 and a bottom wall (not shown). Interior walls 22 and 24 are parallel to side wall

Figure 2:
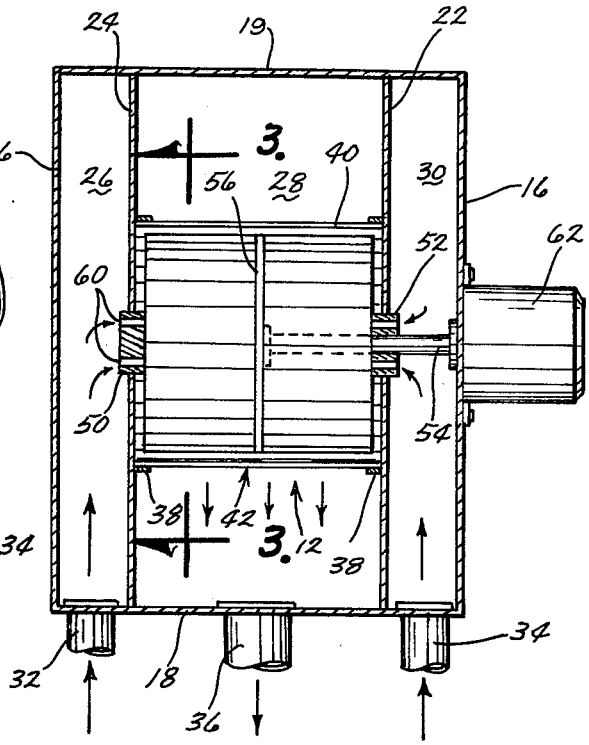
FIG. 2 is a sectional side view seen on line 2—2 of FIG. 1.

16 and form interior chambers 26, 28 and 30 (FIG. 2). Air inlet tube 32 passes through front wall 18 to interior chamber 26 as does inlet tube 34 to interior chamber 30. Air outlet tube 36 passes through front wall 18 to interior chamber 28. Tubes 32, 34 and 36 provide the only fluid communication to the interior of housing assembly 14.

Fan rotor means 12 comprises a pair of spaced apart, inwardly facing, circular angle iron rims 38 having a plurality of circumferentially spaced baffle plates 40 extending therebetween and securely attached thereto to form an integral one piece baffle cage 42. Baffle plates 40 are individually comprised of plate 44 joined to plate 46 at an obtuse angle in a more or less L-shaped to form a scoop configuration. Baffle cage 42 is positioned in interior chamber 28 (FIG. 2) between walls 22 and 24 with rims 38 being securely mounted to interior walls 22 and 24. The fan rotor 48 comprises bushings 50 and 52, drive shaft 54, circular center plate 56, and rotor blades 58.

Bushing 50 is mounted in an aperture (not shown) in interior wall 24 and contains air apertures 60 to allow passage of air from chamber 26 into chamber 28. Bushing 52 is likewise mounted in an aperture (not shown) in interior wall 22 and contains air apertures 60 to allow passage of air from chamber 30 into chamber 28. Bushing 52 also contains an aperture (not shown) to rotatably receive drive shaft 54.

Figure 3:
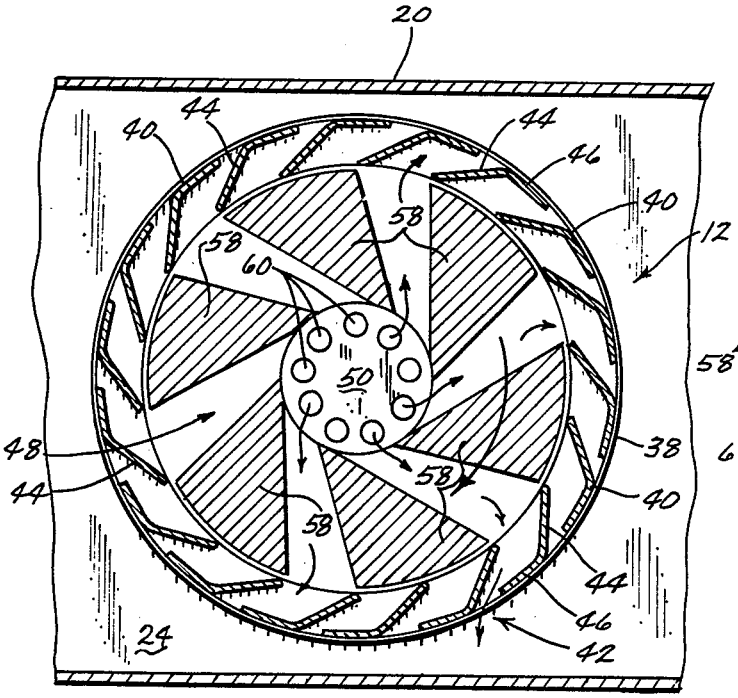
FIG. 3 is an enlarged sectional side view seen on line 3—3 of FIG. 2.

Rotor blades 58 are of triangular cross sectional configuration as shown in FIG. 3 and are securely attached in a circumferentially spaced relationship to each side of circular center plate 56 so as to project outwardly from plate 56 and perpendicular thereto. Center plate 56 and blades 58 are rotatably mounted within baffle cage 42 with drive shaft 54 passing through bushing 52 and securely mounted to center plate 56. Motor 62 drives drive shaft 54 and in turn center plate 56 and blades 58. The apex of blades 58 form a bore 64 (FIG. 4) so as to rotate around bushings 50 and 52 as shown in FIG. 3.

In operation, motor 62 rotates drive shaft 54 and therefore plate 56 and blades 58. Air is drawn through inlet tubes 32 and 34 into chambers 26 and 30 respectively (FIG. 2). The air is then drawn through air aperture 60 of bushings 50 and 52 into bore 64. The rotation of blades 58 drives the air through baffle cage 42 with baffle plates 40 directionalizing the air flow as illustrated by the arrows in FIG. 3 providing high velocity directional air flow out of outlet tube 36. High velocity air flow is obtained, yet the fan rotor is in the interior of housing assembly 14 and not accessible to foreign objects.

Thus, it can be seen that the device accomplishes at least all of its stated objectives.

What is claimed is:

1. A rotor fan comprising, a housing having first and second spaced apart opposing walls forming a first interior chamber, a plurality of baffle members extending between said first and second walls and securely mounted in a generally perpendicular relationship thereto to form a cylindrical cage with said first chamber, rotor blade means rotatably mounted within said cylindrical cage, said means comprising a plurality of interconnected blade elements longitudinally parallel to said baffle plates and extending from the inside edge of said baffle members toward the longitudinal center line of said cylindrical cage, said blade elements terminating prior to said centerline to form a cylindrical bore about said centerline, means for rotating said rotor blade means, an outlet tube extending from said interior chamber to the exterior to allow air flow out of said interior chamber, air inlet means to introduce air into said bore to be propelled by said blade elements through said baffle member and out said outlet tube, said baffle members being plates having first and second legs with the angle between said first leg and second leg being an obtuse angle and said baffle members being disposed between an securely attached at each end to a pair of ring shaped rims, one of said rims securely mounted to the interior of said first wall and the other of said rims securely mounted to the interior of said second wall with said first leg of said plate being more or less tangential to the outer circumference of said rim and said second leg projecting inwardly therefrom.

2. The device of claim 1 wherein said housing comprises a plurality of exterior walls forming a second interior chamber adjacent said first wall, said second interior chamber containing air inlet opening to provide air flow from said exterior to said second interior chamber.

3. The device of claim 2 wherein said blade elements are securely attached to a circular plate in generally perpendicular disposition thereto, said plate being rotatably mounted within said cage.

4. The device of claim 3 wherein said means for rotating said rotor blade means comprises a drive shaft having one end securely attached to the center of said circular plate and the other end adapted for connection to a rotor means for rotational movement of the drive shaft, and further comprising means for rotatably supporting said drive shaft on said first wall and one of said exterior walls in axial alignment with said bore.

5. The device of claim 4 wherein said air inlet means comprises a first bushing mounted within an aperture within said first interior wall, said bushing having an opening therethrough in which said drive shaft is rotatably supported and air inlet apertures in communication with said bore such that air flow through said inlet apertures enters said bore.

* * * * *